United States Patent [19]

Ponomarev et al.

[11] 4,211,606

[45] Jul. 8, 1980

[54] METHOD FOR THERMAL PROCESSING BITUMEN-CONTAINING MATERIALS AND DEVICE FOR REALIZATION OF SAME

[76] Inventors: Jury V. Ponomarev, ulitsa Chkalova, 39, kv. 15; Alexandr S. Smirnov, Leninsky prospekt, 73/8, kv. 149; Boris I. Tyagunov, ulitsa Panferova, 8, kv. 22; Vitaly I. Chikul, ulitsa Panferova, 8, kv. 170, all of Moscow; Mark Y. Gubergrits, ulitsa Lomonosova, 17, kv. 12, Tallin; Mart A. Marguste, ulitsa Rebase, 3, Tallin Nymme; Viktor M. Efimov, ulitsa Vyidu, 4, kv. 5; Evgeny F. Petukhov, Narvskoe shosse, 53, kv. 14, both of Kokhtla-Yarve; Yalmar S. Ulanen, ulitsa Kuuze, 3, kv. 3; Olga S. Chikul, ulitsa Uus, 13, kv. 5, both of Estonskaya SSR, Kiviyli, all of U.S.S.R.

[21] Appl. No.: 605,816

[22] Filed: Aug. 19, 1975

[51] Int. Cl.[2] ..... C10B 49/18

[52] U.S. Cl. ..... 201/12; 48/206; 201/22; 201/28; 201/42; 202/108; 208/11 R; 209/139 R; 209/143

[58] Field of Search ..... 201/12, 18, 22, 28, 201/42; 208/8, 11 R; 209/139 R, 143; 202/108; 48/206

[56] References Cited

U.S. PATENT DOCUMENTS

| | | | |
|---|---|---|---|
| 2,741,549 | 4/1956 | Russell | 201/31 X |
| 3,167,494 | 1/1965 | Crawford | 201/12 |
| 3,565,751 | 2/1971 | Hoekstra | 208/11 R X |
| 3,597,347 | 8/1971 | Ellington, Jr. | 201/12 |
| 3,655,518 | 4/1972 | Schmalfeld et al. | 201/12 X |
| 3,865,242 | 2/1975 | Musto | 209/143 |

FOREIGN PATENT DOCUMENTS

| | | | |
|---|---|---|---|
| 689465 | 6/1964 | Canada | 201/12 |
| 1135419 | 8/1962 | Fed. Rep. of Germany | 201/12 |

*Primary Examiner*—Arnold Turk
*Attorney, Agent, or Firm*—Fleit & Jacobson

[57] ABSTRACT

Bitumen-containing material is processed by distillation with a solid heat-carrier with subsequent gasification of the distillation residue and combustion of the gasification residue in an aerofountain furnace. During gasification, the formed flue gas and ash are heated and part of ash is used as the heat-carrier. The flue gas and ash are withdrawn from the process simultaneously in the form of their suspension in air, from which the heat-carrier is isolated for the distillation process, the consumption of the heat-carrier being controlled by withdrawing part of the suspension containing fine fraction of ash before the heat-carrier is isolated.

The device for realization of the proposed method comprises an aerofountain furnace and is provided with a means for delivering the heat-carrier into the reactor, which is actually a separator with leading-in and leading-out gas ducts and a by-pass gas-duct provided with a controlled valve intended to control the delivery of the aerosuspension through the bypass gas-duct.

2 Claims, 1 Drawing Figure

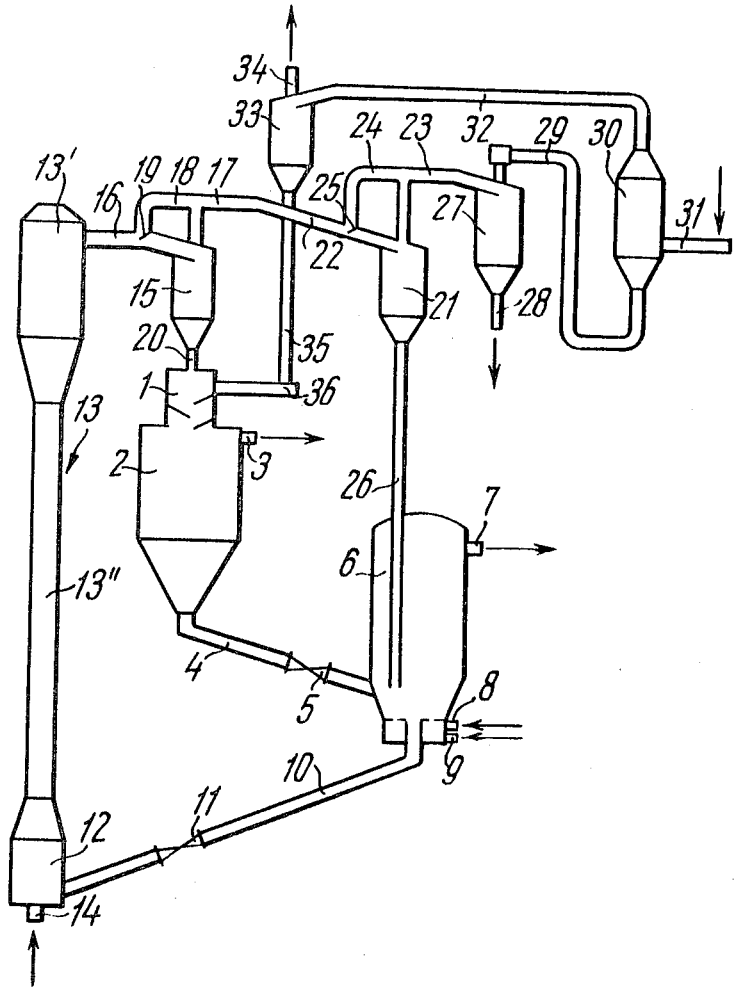
34
33
24
23
32
29
30
13'
19
18
17
16
25
27
31
22
15
21
28
20
35
1
36
13
2
3
26
7
6
13"
4
5
8
9
10
11
12
14

METHOD FOR THERMAL PROCESSING BITUMEN-CONTAINING MATERIALS AND DEVICE FOR REALIZATION OF SAME

This invention relates to methods for processing fuels and devices for carrying out of these methods, and more particularly it relates to the method of thermal processing of solid bituminous materials used in the manufacture of high quality fuels (gas and resin), intermediates for the chemical industry used in construction, in agriculture, and it relates also to devices for carrying out of this method.

The invention can be used most efficiently in the fuel industry, and also in energy production, for utilization of solid fuels, particularly high-ash fuels (e.g. shales).

The ever growing demand for energy in highly industrialized and developing countries, the natural limitations of high-quality fuel deposits, and, incidentally, the quite uneven distribution of such deposits, make it necessary for many countries to utilize low-grade fuels on an increasing scale. At the present time many materials that had not been earlier regarded as fuel (e.g. some grades of shales containing little resins, bituminous sands, etc) are used as the source of energy.

In the modern quarry, solid fuel is crushed to give much dust and minor particles, which also complicates the process of fuel utilization.

Operation of boilers and other process units (for example furnace heaters) on low-grade fuels decreases the efficiency of the equipment, while transportation, storage, and handling of large amounts of such fuel involves high expenditures and deteriorates the working conditions and environment.

The efficiency of low-grade fuels can be increased by preliminary processing involving the distillation of fuel by heating to a temperature of 400°-650° C. in a closed space. The resultant product is a high-quality liquid ($Q$=8000-10000 Kal/kg) and gaseous ($Q$=4000-12,000 Kal/cu.m.) fuel, that can be used also as intermediates in the manufacture of plastics, adhesives, rubber, and other chemical products.

Known in the prior art are methods for the distillation of fuels by mixing them with a hot solid carrier, characterized in that ash returned from the previous cycle of fuel processing is used as the carrier, and that heating is effected by virtue of the energy liberated in burning residues of the distillation process (See, for example, U.S. Pat. Nos. 2,600,430 and 2,676,908). According to these patents, the devices intended for carrying out these methods comprise a train of a fuel mixer, a reactor for distillation, a feeder of distillation residues for their utilization by combustion to heat the carrier material, and a device for delivery of the carrier into the reactor.

In processing low-ash fuels, such as brown coal, the solid residue of the distillation process, semicoke, has high heating value (4000-6500 Kal/kg) and can be used both as a fuel and as an intermediate in the chemical industry.

But in processing high-ash fuels, e.g. shales, the combustible components remain in the solid residue and cannot be used as fuel due to the high incineration degree. For example, the residue of distillation of even a high-quality shale contains as a maximum 2-4 percent of combustible components.

The ash remaining after the distillation process can be utilized in construction and agriculture, but its use is limited by the harmful effects of combustible residues that deteriorate the binding properties of mortars, fillers, etc. Hence additional expenditures are required for treatment of distillation residues.

Known in the prior art is also a method of thermal processing of fuel by distillation with a solid heat-carrier with subsequent additional heating of the distillation residue with the solid heat-carrier, or with additional heating and gasification with a gas containing carbon monoxide, methane, and water vapour, (See West Germany Pat. No. 972,925). According to this method, gasification of the distillation residue is incomplete and the concentration of combustible components in the gasification residues exceeds the amount of fuel required to heat the carrier.

This disadvantage can be removed by gasifying distillation residues with steam-air or steam-oxygen blowing (See U.S. Pat. No. 2,741,549).

According to this method, distillation, gasification, combustion of gasification residue, and simultaneous heating of the heat-carrier are all done in fluidized beds, while the fuel and the distillation residue are delivered to the step of mixing with the heat-carrier by steam or other fluidizing agent. The heat-carrier, delivered to the zone of distillation and gasification, is taken from the fluidized bed of the heating zone and its flow-rate is controlled in the current of the dense heat-carrier bed.

The device for carrying out said method comprises a process train consisting of a mixer of fuel and heat-carrier, a distillation reactor, a reactor for gasification of distillation residues, a feeder for delivery of gasification residues to a furnace for their combustion and for simultaneous heating of the heat-carrier, and means for delivery of the heat-carrier to the reactors.

This method and device for processing high-ash fuels have the following disadvantages.

Combustion of a polydispersed gasification residue containing a small quantity of combustible components in a furnace of the fluidized-bed type cannot be highly efficient since the fluidized bed permits inefficient combustion due to the fact that part of the combustible particles are entrapped in an intensely agitated flow of untreated particles and carried away from the furnace before the combustible components are all burned.

Moreover, combustion of large particles of the gasification residue containing small quantities of combustible materials is difficult and requires much time, while the mean time during which small and large particles are present in the bed is practically the same. As a result, smaller particles are present in the fluidized bed for a period of time that greatly exceeds the time required to burn them, which increases the bulk of the material that is present in a furnace for a unit time, involves undue attrition of the material, and hence causes clogging of the system with dust, and undue loss of liquid and gaseous products.

The disadvantage of fuel distillation in a fluidized bed is also due to the fact that part of new portions of fuel is entrapped in the outflowing current of the reaction products due to intense agitation in the liquid bed, and is withdrawn from the reactor before the distillation process is completed with the result that the yield of the distillation products is reduced.

Owing to the intense agitation, the heat-carrier delivered to the distillation and gasification zones is removed from the fluidized bed and for these reasons both large and small particles of ash are used as the heat-carrier, and the circulating system is clogged with additional portions of dust.

Attempts to control the consumption of the flow of solid heat-carrier heated to a temperature of 700°-1100° C. by means of gates or other mechanical shutters, is ineffective.

Using steam or other fluidizing agents to deliver fuel and distillation residues for mixing with the heat-carrier requires additional expenditures for the preparation of the agent, and, moreover, the distillation and gasification products are diluted with these fluidizing agents.

It is an object of this invention to provide a highly efficient method for processing high-ash polydispersed bitumen-containing materials.

Another object of the invention is to increase the efficiency of combustion of high-ash polydispersed gasification residues.

Still another object of the invention is to lower dust content of the distillation and gasification products.

A still further object of this invention is to improve reliability of operation of means controlling heat-carrier consumption.

These and other objects of the invention are attained in that in the method for thermal processing of solid bitumen-containing materials by their distillation with a solid heat-carrier with subsequent gasification of the distillation residue and combustion of the gasification residue, during which the flue gas and ash are heated, and part of said ash is used as the heat-carrier, according to the invention, gasification residue is burned in an aerofountain furnace-heater, and the hot ash and flue gas, formed in combustion of the gasification residue, are withdrawn together in the form of suspension in air, from which the heat-carrier is separated, the consumption of the heat-carrier required for the distillation process being controlled by withdrawing part of the suspension containing smaller fractions of ash before the heat-carrier is separated.

The method of the invention can be used to process low-grade, high-ash bitumen-containing materials in which the mineral component content is as high as 90 percent, and which were not previously considered as fuel, for example, some low-grade shales, bituminous sands, etc., and to prepare from them high-quality fuels (gas and resins), intermediates for the chemical industry (olefins, resorcinols, etc), and also materials used in construction and agriculture.

Combustion of gasification residues in the aerofountain furnace ensures highly effective combustion of the material containing 2-4 percent of combustible components, mainly hydrocarbons and pyrite sulphur (if the latter is present in the process material).

The highly efficient combustion of gasification residue containing a minimum quantity of combustible components ensures maximum yields of the gasification products, which ensures high total yield of products of the thermal processing (to 70-90 percent with respect to potential heat value of the starting material).

The afficiency of the process increases in processing materials in which the yield of volatile products is low with respect to the mass of combustible components.

Effective thermal processing and combustion of the gasification residue with low mechanically incomplete combustion makes it possible to prepare a high-quality ash residue suitable for use, without any additional processing, in construction, in the building-material industry, and in agriculture.

Simultaneous withdrawal of hot ash and flue gas, formed in combustion of gasification residue, makes it possible to isolate coarse fractions as heat-carrier and to withdraw fine fractions from the process, which simplifies the system of purification and decreases dust content of the products of thermal decomposition in other words, improves the quality of the commercial product.

It is recommended that the distillation mixture be prepared by delivering the heat-carrier and the bitumen-containing material in the form of two freely falling flows, and allowing them to interact with each other at a certain point of their flows.

Mixing the bitumen-containing material with the heat-carrier at the moment of their free falling rules out the necessity of using any fluiding agents (steam, gas), the expenditures are lowered, and the products of thermal decomposition are not diluted with the fluidizing agent.

It is also recommended that the distillation process be carried out in a dense moving bed of the bitumen-containing material and heat-carrier. This makes it possible to keep all particles of the processed material inside the reactor for the length of time sufficient for complete isolation of volatile substances and thus to attain the maximum yield of the distillation process. Moreover, the entrainment of dust in the flow of volatile substances is minimized in the dense moving bed.

In the device for carrying out the inventive method, comprising a train of a mixer for fuel and heat-carrier, a distillation reactor, a reactor for gasification of the distillation residue, a feeder for delivery of the gasification residue into the furnace for final combustion of the gasification residue and for simultaneous heating of the heat-carrier, and also a means for delivery of heat-carrier into the reactor, according to the invention, an aerofountain furnace is used as the furnace, and the means for delivery of heat-carrier into the reactor comprises a separator for isolation of the heat-carrier and leading-in and leading-out gas-ducts, and a by-pass gas-duct, that is communicated with the upper part of the leading-in and the leading-out gas-ducts, and provided with a controlled valve that regulates the delivery of the suspension through the by-pass gas-duct.

The device of the invention makes it possible to carry out the method of thermal processing of solid bitumen-containing materials, polydispersed and high-ash materials in particular, by their distillation with a solid heat-carrier with subsequent gasification of the distillation residues and final combustion of the gasification residue, during which flue gas and ash are heated, and part of the ash is used as the heat-carrier. The resultant product is high-quality fuel (gas and resin) useful as intermediates in the chemical industry (olefins, resorcinols, etc), and also as materials in agriculture and construction.

The aerofountain furnace ensures highly effective conditions for combustion of the gasification residue containing 2-4 percent of combustible components, as a result, of which the yield and the quality of the reaction products are improved.

The means for delivery of the heat-carrier into the reactor comprises a separator for isolation of the heat-carrier with leading-in and leading-out gas-ducts, and a by-pass gas duct that communicates with the upper part of the leading-in and leading-out gas-ducts, and is also provided with a controlled distributing valve which makes it possible to isolate the course fraction of ash. This reduces the dust content of the distillation and gasification products and improves the quality of ash, which is withdrawn in the form of a fine and well incinerated product.

Moreover, the separation of the heat-carrier from its suspension in air makes it possible to control its consumption in an even and stable mode.

Other objects and advantages of the invention will become subsequently clear from a detailed description of an example of a practical embodiment with reference to the appended drawing showing a structural diagram of the device for carrying out the method according to the invention.

The device comprises a mixer 1 made as a vertical vessel with shelves installed inside it in two rows and inclined in the direction of the material flow. The mixer 1 is connected with a reactor 2 intended for distillation, made in the form of a hopper or a shaft, (or in the form of a rotary drum for fuels tending to bake or sinter). The reactor 2 is provided with a branch 3 from which the products of distillation are discharged. The reactor 2 is connected through a pipe 4 provided with a gate 5 to the fluidized bed reactor 6 intended for gasification of the distillation residue.

The reactor 6 is provided with a branch 7 from which the volatile products of gasification are withdrawn, and branches 8 and 9 through which air and steam are delivered into the reactor.

The reactor 6 is connected through a pipe 10, provided with a gate 11 and a feeder 12 (pneumatic type), to a furnace 13 of the aerofountain type comprising a combustion chamber 13' connected with the feeder 12 through a pipe 13''.

The furnace 13 is provided with a branch 14 passing through the feeder 12 intended for blowing air, although air can be delivered by any other method.

The furnace 13 is connected with the means for delivery of the heat-carrier into the reactor 2. This means comprises a separator 15 for the heat-carrier, a leading-in gas duct 16 and a leading out gas-duct 17, and also a by-pass gas-duct communicating with the upper part of the leading-in gas duct 16 and the leading-out gas duct 17. The by-pass gas duct 18 is provided with a controlled valve 19, for example, with a throttle type valve.

The valve 19 can be controlled automatically by temperature of the distillation residue, or manually.

The separator 15 of the heat-carrier is connected with the mixer 1 through a pipe line 20. The gas duct 17 is connected with the means for delivery of the heat-carrier to the reactor 6. This means comprises a separator 21 of the heat-carrier, leading-in and leading-out gas ducts (22 and 23) and a by-pass gas duct 24 communicating with the upper part of the leading-in gas-duct 22 and leading-out gas-duct 23. The by-pass gas-duct 24 is provided with a controlled valve 25 the design of which can be the same as that of the valve 19.

The valve 25 can be controlled either manually or automatically by the temperature of the gasification residue.

The separator 21 is connected with the gasifier reactor 6 through pipe line 26 for the heat-carrier.

Gas-duct 23 is connected with a separator 27 having a duct 28 for discharging ash.

Separator 27 is connected through a gas-duct 29 to a drier 30, for example of the aerofountain type, provided with a feeder 31, for example of a screw type, that delivers bitumen-containing material.

The drier 30 is connected through a gas duct 32 to a separator 33 provided with a branch 34, for discharging flue gas from the unit, and a pipe line 35 for delivering dry bituminous material into the mixer 1 by means of a feeder 36 (for example, of a screw type).

The inventive device operates as follows.

Crushed bitumen-containing material, for example, shale, is delivered continuously by the feeder 31 into the drier 30 where it is dried with flue gas of the furnace 13 separated from ash in the separator 27.

The suspension of dry shale and flue gas in air is delivered from the drier 30 along the gas duct 32 into the separator 33. Flue gas from the separator 33 is delivered through branch 34 for separation from dust, and then discarded into atmosphere, whereas dry shale separated in the separator 33 is delivered through gas-duct 35 into the feeder 36 that delivers it into the mixer 1.

Solid heat-carrier, the residue of the processed portion of shale, heated in the furnace 13 to a temperature of 700°1100° C. is delivered, also continuously, into the mixer 1 along the pipe-line 20 from the separator 15.

Shale and the heat-carrier are delivered into the mixer 1 in the form of two freely falling flows, that are brought into active contact with each other as a result of which they become mixed.

The mixture of shale and heat-carrier from the mixer 1 is delivered into the reactor 2, where shale in the dense moving current is heated (on account of the physical heat of the heat-carrier) to a temperature of 450°–650° C. and kept for a period of time required to ensure its complere thermal destruction-distillation.

As the particles of shale and heat-carrier move in the downstream flow in the reactor 2, they do not move with respect to one another. For this reason, materials tending to bake or sinter should be processed in reactors made in the form of rotary drums, in which the mixture is intensely mixed along the entire path from the inlet point to the point of their discharge from the apparatus, and thus prevented from baking into large pieces.

Volatile products formed in the distillation process (vapours of resin, water, and distilled gas) are withdrawn from the reactor 2 through the branch 3, purified from dust and condensed, and utilized, for example, as fuel or as intermediates in the chemical industry. The solid residue of the distillation process, the mixture of solid heat-carrier and semicoke formed from shale by its thermal distruction, is delivered along the pipe line 4 into the gasifier 6.

In the gasifier 6 the distillation residue is gasified with steam-air or steam-oxygen blow through branches 8 and 9.

As a result of this blowing, the temperature of the distillation residue increases to 600°–900° C. on account of the heat of the exothermic reactions that take place in gasifying the combustible components of semicoke. All volatiles are practically liberated and part of hydrocarbons in the distillation residue is gasified.

Part of heat required for additional heating of the processed distillation residue can be obtained by delivering solid heat-carrier into the reactor 6 along the pipe line 26 from the separator 21. This decreases the consumption of blowing gas, and the resultant gas is less diluted with the nitrogen of the blowing gas.

Gas liberated from the distillation residue, as well as resin vapour and steam, are withdrawn from the gasifier 6 through 7, purified, and delivered for their further utilization, for example, as fuel or intermediates for the chemical industry.

The solid residue of gasification—the mixture of the heat-carrier and coke, formed from semicoke on account of additional isolation of volatile products and gasification, containing insignificant quantities of combustible substances, mainly carbon, is delivered from the reactor 6, through pipe line 10 into the furnace 13 by feeder 12.

Combustible components of coke are finally burned in the furnace 13 by blowing air through branch 14. The process is exothermic, and ash produced in burning coke, flue gas, and the heat-carrier circulating in the device are heated to a temperature of 700°–1100° C.

Owing to the upstream flow of the blown gas, and to the corresponding shape of the furnace chamber 13', fountain-shaped motion of the gasification residue is attained in the aerofountain furnace 13.

The gasification residue delivered into the lower part of the chamber 13' is lifted by the upstream flow of the blown gas. In the upper part of the furnace chamber 13' the material loses its speed and part of it is discharged from the furnace 13, while part of the material is returned into the lower part of the furnace chamber 13', and is lifted again together with new portions of the gasification residue into the upper part of the chamber 13'.

Since particles of this material differ in size and are entrapped in the upstream flow in different modes, they are recirculated in the process of combustion of the semidispersed gasification residue different number of times, and hence the time of their presence in the furnace chamber 13' will be different too. Large particles that are entrapped in the upstream flow with greater difficulty will be present in the furnace for longer periods of time, while smaller particles will be discharged sooner from the furnace.

By properly selecting the operating conditions and the design of the furnace, it is possible to ensure the presence of particles of different size inside the chamber 13' for periods of time sufficient to ensure complete combustion of different particles.

Ash and flue gas are discharged from the furnace 13 simultaneously, in the form of their suspension in air. The suspension is delivered into the gas-duct 16 where it is divided into flows by the valve 19. One flow, taken from the lower part of the gas-duct 16 contains large fractions of ash in the quantity required to meet the demands of the reactor 2 for heat-carrier, and it is delivered into the separator 15. Ash (heat-carrier) isolated in the separator 15 is delivered along the pipe-line 20 into the mixer 1 where it is mixed with dry shale. The mixture of the heat-carrier and shale is delivered into the reactor 2. The suspension of ash residues and flue gas in air is delivered from the separator 15 into the leading-out gas-duct 17.

The other flow of the suspension divided by the valve 19, containing smaller fractions of ash, is delivered from the upper portion of the leading-in gas duct 16 through the by-pass gas-duct 18 into the leading-out gas duct 17 and mixed with the suspension discharged from the separator 15.

Heat-carrier is delivered to the reactor 6 in the same manner as it is delivered to the reactor 2.

The largest fraction of ash from the suspension delivered through gas-duct 17 into gas-duct 22 is used as the heat-carrier for the reactor-gasifier 6, the fraction being separated in the separator 21. The suspension in air is divided by the valve 25. The flow of the suspension containing finer fraction of ash is delivered through by-pass gas duct 24 into the leading-out gas-duct 23 by-passing the separator 21. The heat-carrier separated in the separator 21 is delivered through pipe-line 26 into the reactor 6.

The above specified order of isolation of the heat-carrier ensures separation of large-particle heat-carrier into the reactor 2, which reduces the dust content of the volatile products of distillation. Whenever it is necessary to reduce the dust content of the gas formed in the reactor 6, and to lower the requirements for dusting of resinous products of distillation isolated in the reactor 2, for example, using part of resin for preparing road-boiling materials, the order of separation of the heat-carrier, can be reversed. The heat-carrier isolated in the separator 15 is delivered into the reactor 6, while the heat-carrier isolated in the separator 21 is delivered to the reactor 2.

The suspension transported through the leading-out gas-duct 23 is delivered into the separator 27, and ash isolated in this separator through duct 28 is delivered for further utilization, for example, in the manufacture of building materials, while flue gas purified from ash is delivered into the drier 30 through the gas-duct 29 to dry new portions of shale.

In stopping for maintenance or repair, the reactor 2 is disconnected from the reactor 6 by gate 5, while the gasifier 6 is disconnected from the feeder 12 by the gate 11.

The heat of materials discharged from the device (ash, steam-gas products of distillation and gasification) and also excess heat of flue gas remaining after drying and heating shale can be utilized by any known method for preheating blowing gas, generation of steam, and for other purposes.

For a better understanding of the invention, the following examples of its practical embodiment are given by way of illustration.

EXAMPLE 1

Shale to be processed has the following properties:

working humidity, 12.5 percent ash content of dry mass, 49.0 percent carbon dioxide (as carbonates) in dry mass, 17.5 percent heating value of dry mass (calorimetric bomb test), 3000 Kal/kg yield of volatiles with respect to combustible mass, 90 percent.

Moist shale crushed to 0–15 mm particle size is delivered continuously into the drier 30, where it is dried and heated to a temperatue of 120° C. with flue gas of the furnace 13. Hot and dry shale is mixed with a solid heat-carrier, heated in the furnace-heater 13 to a temperature of 850° C., in the ratio of 1:1.9. The mixture of shale and heat-carrier is kept in the reactor 2 for 13 minutes at the final temperature of the mixture of 490° C., at which the distillation process occurs. Volatile products liberated in the distillation process contain vapour of resin in the quantity of 148.9 kg per ton of the shale, vapour of benzine 9.2 kg/ton, distilled gas 51.1 kg/ton, and steam 17.5 kg/ton. Semicoke formed from the processed shale, in a mixture with the heat-carrier, is delivered into the reactor 6, where the mixture is heated again with additional portion of the heat-carrier, delivered in the quantity of 1800 kg/ton and gasified with steam-air blowing at a temperature of 750° C. The resultant product is 385 kg of producer gas per ton of shale, continuing 17 kg of steam, while the solid residue of the gasification process containing 4 percent of heat of the starting shale, is given another combustion in the furnace 13. Heat that is required to heat the carrier is obtained by burning 181 kg of producer gas in the furnace 13.

The heat of combustion of resin is 9600 Kal/kg, of gaseous benzine 10,500 Kal/kg, of distilled gas 10,600 Kal/kg–12,300 Kal/kg, and of producer gas 860 Kal/-kg–970 Kal/kg.

85.8 percent of potential heat of shale are converted into commercial products: 54.7 percent into resin, 3.7 percent into gaseous benzine, 20.7 percent into distilled gas, and 6.7 percent into producer gas. The resin can be used in the manufacture of boiler, gas-turbine, and domestic fuels, as additives to sulphurous masouts, detergents, substances controlling erosion of soil, as pest-control agents, plastics, adhesives, etc. Distilled gas containing from 35 to 36 percent of olefins, can be used in the manufacture of polymers, rubber, liquefied gas, domestic fuels, etc.

Ash residue is 435 kg/ton. It can be used as binder in construction, and also as additive in the manufacture of cements. Ash can be used also to lime acid soils in agriculture.

EXAMPLE 2

Bitumen-containing material to be processed has the following characteristics:

working humidity 5.0 percent ash content of dry mass, 75.9 percent heat of combustion of dry mass (colorimetric bomb test), 1450 Kal/kg yield of volatile substances, calculated as combustible components, 50 percent.

Moist material is crushed to 0–15 mm particle size, and is delivered continuously into the drier 30, where it is dried and heated to a temperature of 130° C. with flue gas of the furnace 13. The dried hot material is mixed with a solid heat-carrier heated in the furnace to a temperature of 1000° C. in the ratio of 1:1. The mixture of the material with the heat-carrier is kept in the reactor 2 for 13 minutes at the final temperature of the mixture of 530° C., at which the distillation process occurs. Volatile products liberated in the distillation process contain vapour of resin in the quantity of 24.8 kg per ton of the processed material, vapour of benzine in the quantity of 2.8 kg/ton, distilled gas 29.0 kg/ton and steam 37.8 kg/ton.

Semicoke produced from the material in question is delivered in a mixture with the heat-carrier into the reactor 6 where the mixture is heated with additional portions of the heat-carrier delivered there in the quantity of 1230 kg/ton, and gasified with steam-air blowing at a temperature of 1000° C. The yield of the products obtained in the reactor 6 is as follows (per ton of the starting material): 609 kg of producer gas containing 30 kg of steam, and 1.3 kg of resin. The solid residue of the gasification process containing 9.4 percent of heat of the starting material is given an additional combustion in the furnace 13 where ash is heated to a temperature of 1000° C. The ash residue is 705 kg/ton.

The heat of combustion of resin is 9180 Kal/kg, of gaseous benzine 10,100 Kal/kg, of distilled gas 5300 Kal/kg–7300 Kal/m$^3$ of dry producer gas 1100–1300 Kal/kg.

69.2 percent of potential heat of the starting material are converted into commercial products: 15.0 percent into resin, 1.9 percent into gaseous benzine, 10.2 percent into distilled gas, and 42.1 percent into producer gas.

We claim:

1. A continuous method of thermally processing a solid bitumen-containing material, comprising:

(a) subjecting a mixture containing air and a heat-carrier consisting essentially of hot coke and hot fine ash particles from a previously combusted solid bitumen-containing material to complete thermal destruction in an aerofountain-type furnace at a temperature of about from 700° C. to 1100° C. generated by said mixture of heat-carrier and air, to obtain an air suspension consisting essentially of air, flue gas, and hot, relatively fine ash particles;

(b) separating the air suspension containing the hot fine ash particles into an air suspension carrying a heavier fraction of the fine particles and an air suspension carrying a lighter fraction of the fine particles;

(c) separating the air suspension carrying the heavier fraction of the fine particles from step (b) into an ash for further use as a solid carrier and a residual air suspension containing flue gas and a residue of said heavier fraction of the fine particles;

(d) mixing the solid carrier from step (c) with a fresh, dry, and hot solid bitumen-containing material;

(e) subjecting the resulting mixture of step (d) to distillation at a temperature of about from 450° C. to 650° C. generated by said mixture until the fresh bitumen-containing material is converted into semicoke and liberated volatiles are removed;

(f) subjecting the resulting product from step (e) to gasification by means of steam-air or steam-oxygen whereby the temperature of said mixture containing the distillation residue is raised to about from 600° C. to 900° C. as a result of the exothermic reaction which occurs in gasifying the combustible components of the semicoke liberating volatiles which are removed and converting the semicoke into coke;

(g) recycling the gasification residue as a heat carrier and consisting of hot coke and the hot fine ash particles from the previously combusted solid bitumen-containing material into said aerofountain-type furnace where it is admixed with air and subjected to complete thermal destruction as in step (a) to produce the air suspension of fine particles corresponding to that produced in step (a) which is then recycled as a heat carrier;

(h) mixing the air suspension carrying the lighter fraction of the fine particles from step (b) with the residual air suspension containing flue gas and the residue of the heavier fraction of the fine particles from step (c);

(i) separating the resulting air suspension from step (h) into an air suspension carrying a second heavier fraction of the fine particles and an air suspension carrying a second lighter fraction of the fine particles;

(j) separating the air suspension carrying the second heavier fraction of the fine particles from step (i) into an ash for further use as a second solid carrier and a second residual air suspension containing flue gas and a residue of said second heavier fraction of the fine particles; and (k) mixing the second solid carrier from step (j) with the distillation residue resulting from step (e).

2. An apparatus for the continuous thermal processing of shale comprising a vertically positioned furnace of the aero-fountain type, a mixer, a distillation reactor, and a gasifier, (a) said furnace having an elongated column with a flared upper end serving as a diffuser to separate fine particles of combustion from coarse particles, a combustion chamber integral with said flared upper end of the column, inlet means associated with the lower end of the column for introducing air into the column, and separate inlet means also associated with the lower end of the column for introducing a heat carrier consisting essentially of coke and ash from a previously combusted shale into the column, whereby the mixture of heat carrier and air produce an exothermic reaction raising the furnace temperature to about from 700° C. to 1100° C. to create an air suspension consisting essentially of fine ash particles, and outlet means for discharging said air suspension;

(b) control valve means for separating the air suspension into two flows, a first flow containing the heavier ash particles and a second flow containing the lighter ash particles;

(c) a separator for separating the first flow carrying the heavier particles fraction from step (b) into an ash for further use as a solid carrier and a residual air suspension;

(d) means for introducing the solid carrier from step (c) into the mixer and means for introducing fresh, dry and hot shale into said mixer, wherein these materials are mixed;

(e) means for introducing the mixture from step (d) into said distillation reactor wherein the mixture is distilled at a temperature of about from 450° C. to 650° C., the heat being generated by said hot, fine ash particles of the mixture which serve as a heat carrier, and the fresh shale is converted into semicoke liberating volatiles as the same time;

(f) means for venting and collecting the volatiles (g) means for introducing the distillation residue consisting of semicoke and the ash particles into the gasifier;

(h) means for mixing the second flow containing the lighter ash particles from step (b) with the residual air suspension of step (c) to obtain a second air suspension mixture;

(i) a second control valve means for separating the second air suspension mixture from step (h) into a third flow containing the heavier ash particles and a fourth flow containing the lighter ash particles, and for directing the third flow towards the gasifier and the fourth flow to a discharge point out of the system;

(j) a separator for separating the third flow carrying the heavier particles from step (i) into an ash for further use as a second solid carrier and a second residual air suspension;

(k) means for introducing the second solid carrier from step (j) into the gasifier to mix with the distillation residue containing the semicoke and ash particles from step (g);

(l) means for introducing steam-air or steam-oxygen into the gasifier to raise the temperature to about from 600° C. to 900° C. due to the exothermic reaction produced whereupon the combustible components of the semicoke are gasified liberating volatiles and converting the semicoke to coke;

(m) means for discharging and collecting the volatiles; and (n) means for delivering the heat-carrying gasification residue consisting essentially of coke and ash particles through said inlet means at the lower end of the furnace column into the furnace for recycling as a heat carrier.

* * * * *